US012268296B2

(12) United States Patent
El-Nahal

(10) Patent No.: US 12,268,296 B2
(45) Date of Patent: Apr. 8, 2025

(54) TOY ORGANIZING HAMMOCK

(71) Applicant: Susan L El-Nahal, Potomac Falls, VA (US)

(72) Inventor: Susan L El-Nahal, Potomac Falls, VA (US)

( * ) Notice: Subject to any disclaimer, the term of this patent is extended or adjusted under 35 U.S.C. 154(b) by 0 days.

(21) Appl. No.: 18/543,712

(22) Filed: Dec. 18, 2023

(65) Prior Publication Data

US 2024/0206623 A1 Jun. 27, 2024

Related U.S. Application Data

(60) Provisional application No. 63/434,587, filed on Dec. 22, 2022.

(51) Int. Cl.
*A47B 43/00* (2006.01)

(52) U.S. Cl.
CPC ..... *A47B 43/006* (2013.01)

(58) Field of Classification Search
CPC ..... A47D 9/016; A47D 9/02; A47B 43/006; A45F 3/22; A45F 3/26; A63G 9/00
See application file for complete search history.

(56) References Cited

U.S. PATENT DOCUMENTS 364,592 A * 6/1887 Jones ..... A47D 11/005 297/7
487,246 A * 12/1892 Bunker ..... F21V 21/02 248/343
523,337 A * 7/1894 Ebert ..... A47D 9/02 5/101
595,235 A * 12/1897 Amrock ..... A47D 9/02 297/274
722,034 A * 3/1903 McElwee ..... A63G 9/00 297/180.16
737,276 A * 8/1903 Rote ..... A47C 1/035 297/130
756,230 A * 4/1904 Goddard ..... A45F 3/24 248/580
947,546 A * 1/1910 Hohlfeld ..... A45F 3/22 5/124
1,198,130 A * 9/1916 Hutchings ..... A47D 9/02 5/98.1
1,237,628 A * 8/1917 Ford ..... A47D 11/005 4/547
1,252,824 A * 1/1918 Melniker ..... A47D 9/005 5/202
1,559,303 A * 10/1925 Bates ..... A47D 9/02 5/103

(Continued)

*Primary Examiner* — Patrick D Hawn
(74) *Attorney, Agent, or Firm* — Jason T. Daniel, Esq.; Daniel Law Offices, P.A.

(57) ABSTRACT

A hammock device includes a malleable canopy body and a frame having a plurality of frame rods. Each of the frame rods are removably positioned within a hollow frame channel located along the outer edge of the canopy body. Each end of each frame rod is connected to an adjacent frame rod by an elbow joint to form a frame about the entire outside of the canopy body. Each elbow joint includes a hook which engages a safety chain that suspends the assembled hammock device from a ceiling or other structure. The safety chains include functionality to break or otherwise disengage the frame when a weight of the frame and canopy exceed a maximum threshold.

12 Claims, 3 Drawing Sheets

(56) References Cited

U.S. PATENT DOCUMENTS 4,002,368 A * 1/1977 Ortize ..... A47C 3/0255 5/120
4,101,165 A * 7/1978 Hammer ..... A45F 3/26 5/120
4,375,110 A * 3/1983 Murphy ..... A47D 9/02 403/291
4,550,456 A * 11/1985 Allen ..... A47D 9/016 5/99.1
4,838,609 A * 6/1989 Christensen ..... A47C 3/0255 297/277
5,170,520 A * 12/1992 Milliken ..... A47D 9/008 5/98.1
5,274,863 A * 1/1994 Fountain ..... A47D 9/016 5/120
5,511,258 A * 4/1996 Barr, Sr. ..... A47D 9/02 5/104
5,788,327 A * 8/1998 Gregory ..... A47C 3/0255 297/423.3
5,860,175 A * 1/1999 Saiki ..... A47C 17/84 5/127
6,397,778 B1 * 6/2002 Tripp ..... A01K 1/0353 D30/118
7,406,802 B2 * 8/2008 Stackenwalt ..... E04B 9/18 52/231
8,015,765 B2 * 9/2011 Stackenwalt ..... E04B 9/0428 52/231
9,095,204 B2 * 8/2015 Ou ..... A47C 17/84
9,254,446 B2 * 2/2016 Lacy ..... A63H 33/008
9,630,119 B2 * 4/2017 Fries ..... A63H 33/008
11,079,078 B2 * 8/2021 Wang ..... F21V 13/04
11,564,478 B2 * 1/2023 Gabaldon ..... A45F 3/22
11,751,685 B2 * 9/2023 Hall ..... A47B 51/00 211/113
2006/0103227 A1 * 5/2006 Jorg ..... A63G 9/00 297/452.64
2007/0051858 A1 * 3/2007 Bailey ..... A45F 3/26 248/127
2014/0310872 A1 * 10/2014 Rozman ..... A47D 9/02 5/122
2024/0206623 A1 * 6/2024 El-Nahal ..... A47B 43/006

* cited by examiner

TOY ORGANIZING HAMMOCK

CROSS-REFERENCE TO RELATED APPLICATIONS

This application claims the benefit of U.S. Application Ser. No. 63/434,587 filed on Dec. 22, 2022, the contents of which are incorporated herein by reference.

TECHNICAL FIELD

The present invention relates generally to storage devices, and more particularly to a suspended hammock for receiving and organizing toys.

BACKGROUND

The statements in this section merely provide background information related to the present disclosure and may not constitute prior art.

As any parent will attest, getting children to clean their room can be one of life's most difficult tasks. Whether it is stuffed animals on the bed, or toys on the floor, it can be difficult to persuade children to place such items in the proper location.

Although there are many types of commercially available toy boxes, such items are typically constructed with a function-over-form approach. As such, these devices do not possess anything that would be perceived as fun or even welcoming to a small child, and therefore do nothing to encourage children to place their toys on or within the bin.

Accordingly, it would be beneficial to provide a toy organizing hammock that provide a decorative appearance to a child's room while receiving and organizing any number of different toys, stuffed animals, and other such items so as to provide a fun and interactive experience for a child, thus alleviating the drawbacks described above.

SUMMARY OF THE INVENTION

The present invention is directed to a hammock device. One embodiment of the present invention can include a malleable canopy body for receiving and storing toys. A plurality of frame rods can be positioned within a series of hollow channels along the outer edge of the canopy body, and the ends of each frame rod can be connected by an elbow joint to form a frame about the entire outside of the canopy body.

In one embodiment, a plurality of safety chains are connected to the frame by hooks, and the safety chains secure the hammock device to a ceiling by mounting hardware located on the distal end of each chain. Each of the safety chains include functionality to break or otherwise disengage the frame if a weight of the frame and canopy exceed a maximum threshold.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, the term "resilient memory" is defined as the ability of a component to maintain a particular shape and to attempt to return to the particular shape after being bent, folded, twisted or otherwise manipulated.

Figure 1:
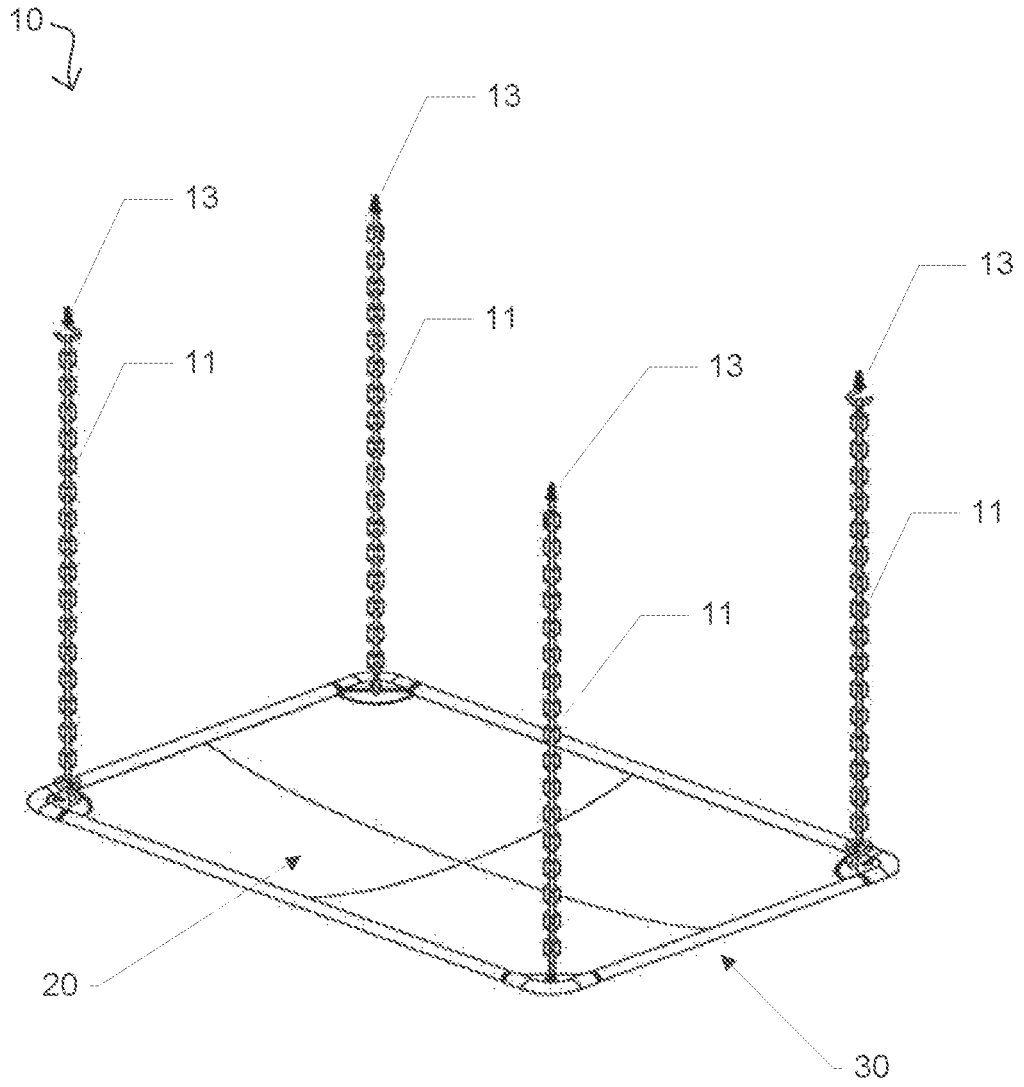
FIG. 1 is a perspective view of the toy organizing hammock that is useful for understanding the inventive concepts disclosed herein.
Figure 2:
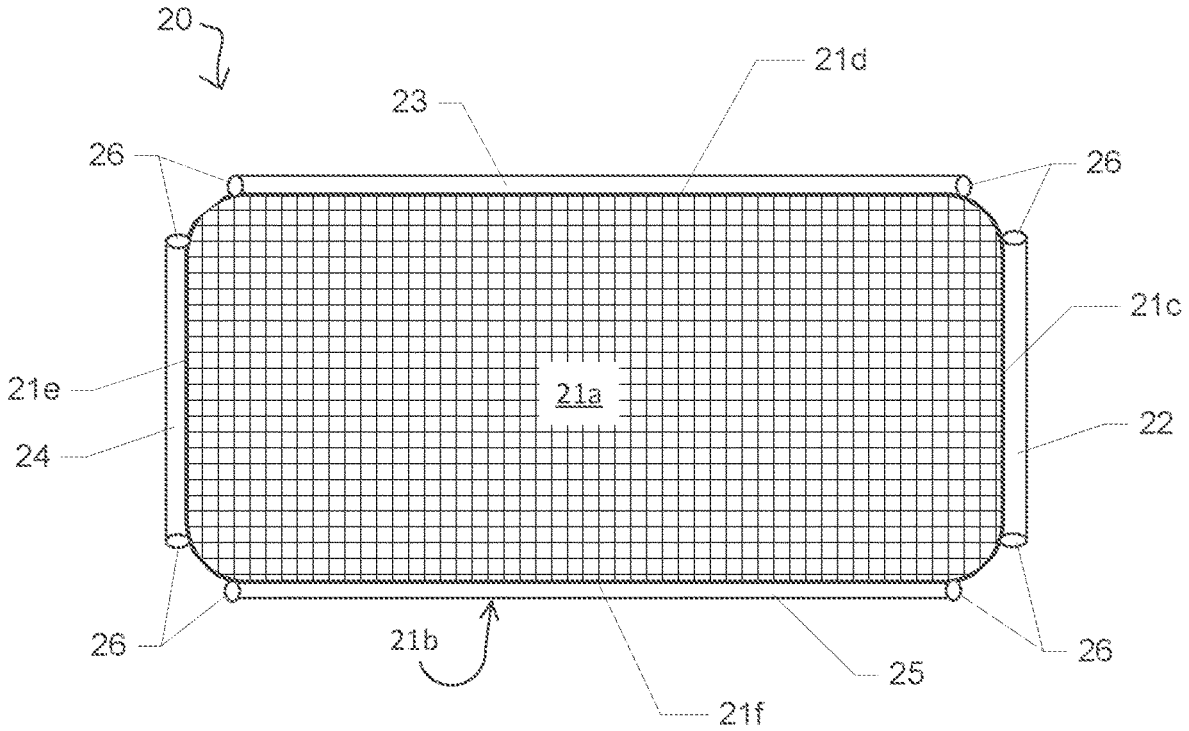
FIG. 2 is a top view of the canopy of the toy organizing hammock, in accordance with one embodiment of the invention.
Figure 3:
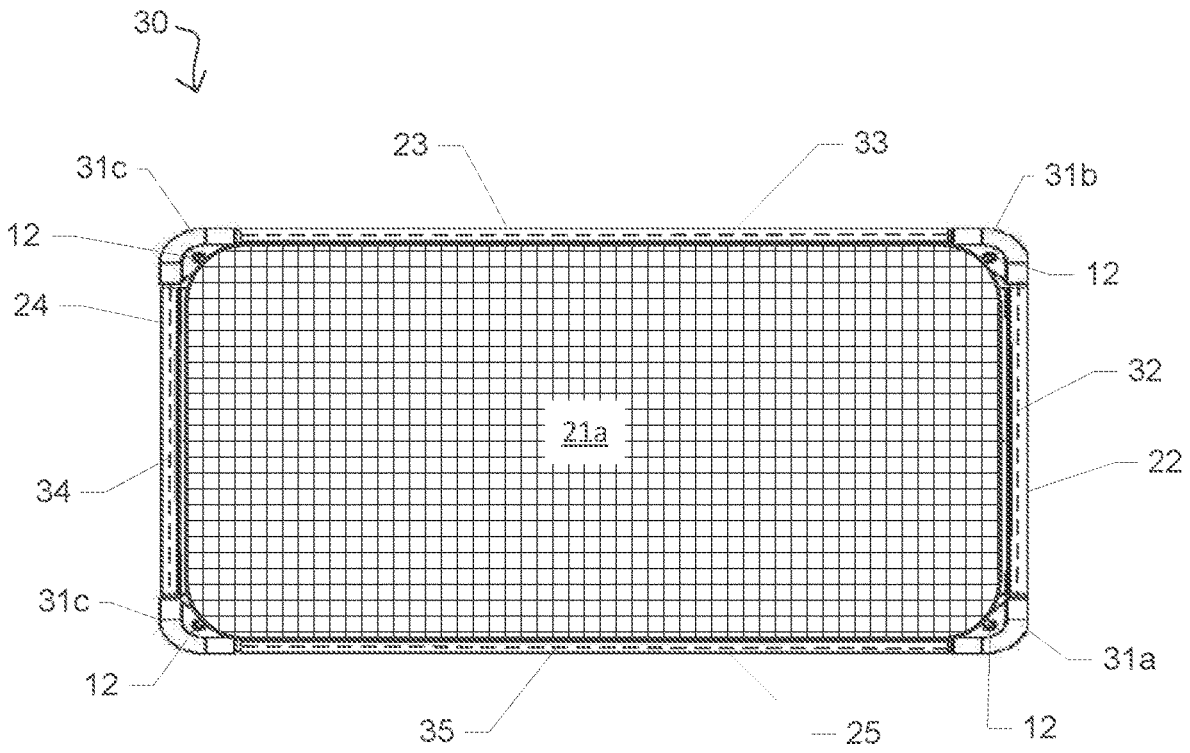
FIG. 3 is a top view of the canopy and frame portions of the toy organizing hammock, in accordance with one embodiment of the invention.

FIGS. 1-3 illustrate one embodiment of a toy organizing hammock device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of the assembled device 10 that includes, essentially, a plurality of suspension members 11, fastening hardware 13, a canopy body 20, and a frame 30.

As shown best at FIG. 2, one embodiment of the canopy body 20 can include a generally rectangular-shaped body member having a top surface 21*a*, a bottom surface 21*b*, and side surfaces 21*c*, 21*d*, 21*e* and 21*f*. A series of hollow frame channels 22, 23, 24 and 25 can be positioned along each of the side surfaces, with channel openings 26 located at each corner of the main body.

In the preferred embodiment, the canopy body will be constructed from an elastomeric mesh material such as stretchable nylon mesh, for example, so as to be able to allow a user to see through the openings in the material to view items resting on the canopy, and to permit the shape of the canopy to stretch as additional items are added. Of course, the canopy body is not limited to the use of nylon mesh, as any number of different lightweight and malleable materials may also be used.

As shown at FIG. 3, one embodiment the frame 30 can include frame rods 32, 33, 34 and 35, each having a shape and size that is complementary to the shape and size of the frame channels 22, 23, 24 and 25, respectively. Each of the rods are removably positioned within the respective frame channel, and each of the frame rods are connected to the adjacent frame rod via hollow elbow joints 31*a*, 31*b*, 31*c* or 31*d* to form the assembled hammock.

Unlike hammocks designed for users to sit or lay in, the frame 30 of the storage hammock 10 is designed to completely encircle the canopy body to provide a rigid outer surface from which the canopy body stretches downward as additional items are added. Such a feature results in the frame forming an upper lip to prevent items stored on or within the hammock from falling out.

In the preferred embodiment, the frame rods will be constructed from a lightweight and sturdy material such as plastic, for example, however any number of other materials are also contemplated.

As noted above, the canopy body can include any number of different shapes and sizes. As such, the frame 30 will be manufactured so as to include a shape and size that is complementary to the shape and size of the outer periphery of the canopy body so as to completely surround the same. To this end, both the canopy and frame may form other shapes such as square, rectangular, circular, or ovoid, among many others, for example.

Connectors 12 such as the illustrated hooks are positioned along each of the elbow joints and engage the plurality of suspension members 11 shown at FIG. 1. In the preferred embodiment, the suspension members can each include an identical length of safety chain (also known as a C-chain) that is constructed specifically to break upon encountering a force exceeding a set threshold such as 5 pounds of weight, for example when suspended from a fastener 13 such as a drywall anchor, for example. The inclusion of a safety chain with the present device is important, as such a feature prevents a child from attempting to climb into/onto the hammock and to eliminate the possibility of a strangulation situation if the child is to become ensnared by the device in operation.

Of course, any number of other types of suspension members and connectors are also contemplated for use herein.

In operation, the assembled hammock device 10 can be suspended from a ceiling or other structure and can function to receive any number of different items such as toys or stuffed animals to reduce clutter within the room. When used, the user can also view the contents of the stored item and retrieve the same easily.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A hammock device, comprising:

a canopy body;

a frame that is secured to the canopy body; and four suspension members, each having a first end that is connected to the frame, and a second end having a fastener thereon, wherein each of the suspension members is constructed from a safety chain that is configured to break upon receiving a force greater than twelve pounds, and wherein each of the fasteners are configured to independently engage a ceiling to hang the canopy body and frame from the ceiling.

2. The device of claim 1, further comprising:

a plurality of frame channels that are positioned along the canopy body.

3. The device of claim 2, wherein the frame includes a plurality of frame rods.

4. The device of claim 3, wherein each of the plurality of frame rods is removably positioned within one of the plurality of frame channels.

5. The device of claim 4, wherein each of the plurality of frame rods are removably connected by a plurality of elbow joints.

6. The device of claim 5, further comprising:

a plurality of connectors that are positioned along each of the elbow joints.

7. The device of claim 6, wherein each of the plurality of connectors comprises a hook.

8. The device of claim 6, wherein the four suspension members are connected to the frame via the plurality of connectors.

9. The device of claim 1, wherein the canopy body is constructed from a malleable and elastomeric material.

10. The device of claim 1, wherein the canopy body is constructed from a see-through mesh material.

11. The device of claim 1, wherein the fastener comprises a drywall anchor.

12. A hammock device, consisting of:

a canopy body;

a frame that is secured to the canopy body; and four suspension members, each of the four suspension members having a first end that is connected to the frame, and a second end having a fastener thereon, wherein each of the suspension members is constructed from a safety chain having a maximum tensile strength of twelve pounds.

* * * * *